US008141657B2

(12) United States Patent
Hutton

(10) Patent No.: US 8,141,657 B2
(45) Date of Patent: Mar. 27, 2012

(54) STEERABLE ROTARY DIRECTIONAL DRILLING TOOL FOR DRILLING BOREHOLES

(75) Inventor: Richard Hutton, Bristol (GB)

(73) Assignee: Merciria Limited, Nottinghamshire (GB)

( * ) Notice: Subject to any disclaimer, the term of this patent is extended or adjusted under 35 U.S.C. 154(b) by 395 days.

(21) Appl. No.: 12/377,023

(22) PCT Filed: Aug. 9, 2007

(86) PCT No.: PCT/GB2007/003027

§ 371 (c)(1),
(2), (4) Date: May 18, 2009

(87) PCT Pub. No.: WO2008/017846

PCT Pub. Date: Feb. 14, 2008

(65) Prior Publication Data

US 2010/0025116 A1 Feb. 4, 2010

(30) Foreign Application Priority Data

Aug. 10, 2006 (GB) ..... 0615883.6

(51) Int. Cl.
*E21B 7/08* (2006.01)

(52) U.S. Cl. ..... 175/61; 175/76; 175/267

(58) Field of Classification Search ..... 175/61, 175/76, 267

See application file for complete search history.

(56) References Cited

U.S. PATENT DOCUMENTS 2,291,100 A 7/1942 Oswald
3,593,810 A 7/1971 Fields
4,947,944 A 8/1990 Coltman et al.
5,038,872 A 8/1991 Shirley
5,050,692 A 9/1991 Beimgraben
5,060,736 A 10/1991 Neff
5,139,094 A 8/1992 Prevedel
5,311,953 A 5/1994 Walker (Continued)

FOREIGN PATENT DOCUMENTS

DE 8911359 11/1989

(Continued)

OTHER PUBLICATIONS

PCT Serial No. PCT/GB2007/003027 filed Aug. 9, 2007, Internat'l Search Report and Written Opinion, 15 pgs.
GB Serial No. GB 2423102A issued Aug. 16, 2006, UK Int'l Search Report, 3 pages.

*Primary Examiner* — William P Neuder
(74) *Attorney, Agent, or Firm* — Andrew F. Young, Esq.; Lackenbach Siegel, LLP

(57) ABSTRACT

The present invention provides a directional drilling apparatus and method for use in drilling bore holes. The apparatus comprises a plurality of movably mounted cutting elements, wherein the cutting elements are movable between radially retracted and extended cutting positions. A rotary valve is provided for synchronizing the movement of the cutting elements between their respective extended and retracted positions. Control of the directional drilling system is affected by synchronized movement of the cutting elements from an inner to an outer radial position in accordance with the angular position of the drill bit. Means are provided for directing high pressure cutting fluid to the region between the cutting elements and the rotatable body to prevent the accumulation of debris that could prevent movement of the cutting elements. The cutting elements enlarge the bore hole formed by the drill bit, so that the cutting elements continuously engage the wall of the bore hole.

42 Claims, 13 Drawing Sheets

U.S. PATENT DOCUMENTS

| | | | | |
|---|---|---|---|---|
| 5,341,886 | A | 8/1994 | Patton | |
| 5,553,678 | A | 9/1996 | Barr | |
| 5,601,151 | A | 2/1997 | Warren | |
| 6,705,413 | B1 | 3/2004 | Tessari | |
| 7,188,685 | B2 * | 3/2007 | Downton et al. | 175/61 |
| 7,849,936 | B2 * | 12/2010 | Hutton | 175/61 |
| 2005/0056463 | A1 * | 3/2005 | Aronstam et al. | 175/61 |

FOREIGN PATENT DOCUMENTS

| | | |
|---|---|---|
| GB | 2423102 | 8/2006 |
| GB | 2434389 | 7/2007 |
| WO | WO 99/24688 | 5/1999 |

* cited by examiner

STEERABLE ROTARY DIRECTIONAL DRILLING TOOL FOR DRILLING BOREHOLES

CROSS REFERENCE TO RELATED APPLICATIONS

This application is related to, and claims priority from, Great Britain Patent Application No. 0615883.6, filed Aug. 10, 2006. This application also relates to and claims priority from Patent Cooperation Treaty (PCT) Application No. PCT/GB2007/003027 filed Aug. 9, 2007, the contents of which are incorporated herein fully by reference.

FIGURE SELECTED FOR PUBLICATION

FIG. 12

BACKGROUND OF THE INVENTION

1. Field of the Invention

The present invention relates to a directional drilling tool for drilling boreholes into the earth. More specifically, the present invention relates to an apparatus comprising a number of movably mounted cutting elements which are movable between first radially retracted positions and radially extended positions for cutting. A rotary valve is provided for synchronizing the movement of the cutting; and, control of the directional drilling system is affected by synchronized movement of the cutting elements from an inner to an outer radial position in accordance with the angular position of the drill bit.

2. Description of the Related Art

Drilling of bore holes is conducted for the exploration and production of hydrocarbon fuels, for example in gas and oil exploration and production. The term "directional drilling" is used to describe the process of drilling a bore hole which is directed, for example, towards a target or away from an area where the drilling conditions are difficult. A directional drilling tool generally sits behind a drill bit and forward of measurement tools. The complete system of bit, directional and measurement tools is called the bottom hole assembly, or "BHA". Currently, there are two main types of directional drilling tools, namely positive displacement mud motors and rotary steerable directional drilling tools.

Positive displacement mud motors are placed in the bottom hole assembly behind the drill bit and operate in either a "sliding" or "rotating" mode. When in sliding mode the drill string is held stationary at the surface. Fluid is then pumped through the positive displacement motor which is situated above the drill bit and connected to the drill bit by a drive shaft and universal joint. Generally there is a fixed bend in the collar between the bit and motor in order to offset the drill bits axis of rotation with the axis of rotation of the BHA. The drill bit will then tend to head in the direction of the bend. By controlling the angle of the bend relative to the formation being drilled, the drilling direction can be controlled. However, the angle of the bend can only be controlled from the surface and measurements of the bend position, commonly known as tool face angle, are sent to the surface using some form of up-hole communication device. As drilling progresses, the BHA advances forward and the rest of the drill string slides along the well bore, hence the term "sliding".

In order to control the rate of turn of the well bore being drilled, the drill string is rotated from the surface while the motor is rotating the drill bit. This effectively cancels the effect of bend between the motor and drill bit. The drill bit will thus head straight ahead. This is commonly known as rotating.

This method of directional drilling, alternating between rotating and sliding, is slower than continual rotation of the drill string from the surface due to the torque limitation of mud motors, and hence slow rates of penetration are achieved when operating in the sliding mode.

Directional drilling while continually rotating the drill string offers the following advantages: better hole cleaning; smoother well bores, extended reach drilling and higher rates of penetration. However, these tools are often complex in design and hence are costly to manufacture and operate.

For example, UK patent application No. GB2259316 describes a modulated bias unit for steerable rotary drilling systems. The modulated bias unit comprises one or more pads which press against the side of the formation being drilled to exert a lateral force on the drill bit. By controlling the direction of the force the drill bit can be steered into the required direction. This enables the drill bit to cut across as well as forwards and is commonly known as "push-the-bit".

Another method involves pointing the bit in the intended drilling direction. For example, International patent application WO0104453 describes a method of deflecting a bit shaft, which runs through the centre of the drilling tool. Deflecting the shaft angles the bit with respect to the remaining parts of the BHA. The bit shaft can be permanently deflected and the position of the deflection controlled, or both the position and magnitude of the deflection can be controlled. These systems typically use a non rotating sleeve which presses against the formation which can be problematic if the hole is drilled slightly over gauge (over size).

"Point-the-bit" drilling can also be performed by contra-rotating a bit shaft in a fixed radius and at a rotation rate equal but opposite to the drill string rotation. For example, International patent application WO9005235 describes such an arrangement. Again this offsets the bit axis of rotation relative to the rest of the BHA and the drill bit will tend to move in the direction of the off-axis offset.

UK patent application No. 0602829.4 describes a directional drilling device for use in drilling boreholes, the device being positionable between a drill bit and associated drill collar of a drill string having a longitudinal drilling axis. The device comprises at least one cutting member movably mounted with respect to a tool body member, the cutting member(s) being movable between a first extended position for engagement with the wall of a bore hole and a second position in which it is retracted from engagement with the wall, and directional control means for synchronizing the movement of the cutting member(s) between the respective extended and retracted positions in accordance with the rotational position of the body member in the bore hole being drilled.

As the moveable cutter, or cutters, are extended and retracted from the rock formation being cut it is possible that over a prolonged period of operation chipping of the cutting faces of the moveable cutter or cutters could occur. Cutter chipping is well known in the art of PDC drill bits and normally occurs when the cutter is removed from the rock formation and then is forced back into the formation during cutting operations. Chipped PDC cutters do not cut efficiently and can lead to undersize holes being drilled and, in extreme cases, result in the drilling operation being terminated prematurely.

Accordingly, there is a need for an improved apparatus and method of controlling the drilling direction of a rotary drill string when drilling boreholes in subsurface formations.

ASPECTS AND SUMMARY OF THE INVENTION

According to an aspect of the present invention, there is provided a method of controlling the drilling direction of a rotary drill string when drilling boreholes in subsurface formations, the drill string having a rotary drill bit at the drilling end thereof and directional control means, adjacent the drill bit, including at least one directional cutting member radially movable with respect to the longitudinal drilling axis of the drill string: the method comprising the steps of drilling a substantially circular cross section pilot bore hole having a radius determined by the cutting radius of the drill bit of the drill string, controllably moving the at least one directional cutting member radially as the drill is rotated so that the radial position of the cutting member, with respect to the drilling axis, is synchronized with the rotation of the drill bit so that the cutting member continuously engages the wall of the pilot bore hole to enlarge the bore hole as the drill rotates and cause the cross-section of the borehole to form an non-circular hole superimposed on the pilot hole when it is desired to cause the direction of the advancing drill bit to deviate from a linear path.

According to another aspect of the present invention there is provided a directional drilling device for controlling the drilling direction of a rotary drill bit when drilling boreholes in subsurface formations; the device being positionable at or towards the end of a drill string for rotation with the drill string about a longitudinal drilling axis; the device comprising: a drill bit having a cutting radius R, the drill bit being connected to a rotatable body at a downhole end thereof for rotation with the body about a longitudinal drilling axis; at least one directional cutting member movably mounted with respect to the body; the directional cutting member being movable radially with respect to the longitudinal axis of the body for engagement with the wall of a pilot borehole cut by the drill bit; the directional cutting member having a minimum cutting radius about the drilling axis greater than R; and, directional control means for synchronizing the radial movement of the directional cutting member with respect to the body in accordance with the rotational position of the body in the bore hole being drilled.

In this aspect of the invention, cutter damage as a result of "chipping" can be reduced by ensuring the radius of the retracted movable cutter(s) is slightly greater than the cutter radius of the drill bit so that the movable cutter(s) is/are always in contact with the formation being drilled whether they are in their radially extended or retracted position According to another aspect of the present invention, there is provided a method of controlling the direction of the drilling axis of a rotatable boring drill bit of a drill string comprising a plurality of hollow drill collars on a drilling end of which the bit is mounted, at least one cutter being mounted on or in the collar adjacent the drill bit for rotation with drill string, the at least one cutter being mounted for movement between a first radially extended position and a second retracted position, and the method comprising the steps of drilling a substantially circular cross section pilot bore hole having a radius determined by the cutting radius of the drill bit, controllably moving the at least one cutter as the drill is rotated so that movement of the movable cutter is synchronized with rotation of the drill so that the movable cutter continuously engages the wall of the pilot bore hole to enlarge the hole as the movable cutter rotates, wherein the synchronized movement of the movable cutter causes the cross-section of the bore hole to become non-circular and form a linear channel parallel to the drilling axis.

In the above mentioned aspect of the invention, the channel is linear in the sense that it extends parallel to the longitudinal direction of the well bore being drilled. The cross-section of the channel in the plane perpendicular to the longitudinal drilling axis is such that it defines part of an eccentric and enlarged circle offset from, and therefore superimposed on, the circular cross-section of the well bore cut by the drill bit (pilot bore hole) and subsequently enlarged by the movable cutters when retracted. This effectively provides the eccentric part of the bore hole with a crescent shape when viewed in the plane perpendicular to the drilling direction. The cross-section of the hole as a whole including the channel may be considered to be ovoid or egg shape having a greater radius of curvature in the region where the movable cutter(s) is/are extended and a smaller radius of curvature where the cutter(s) is/are retracted. This arises from the fact that the movable cutters also enlarge the pilot bore hole when retracted as the cutting radius of the radially retracted movable cutters, with respect to the drilling axis, is greater than the radius of the pilot bore hole.

Control of the directional drilling system is affected by the synchronized movement of movable drilling cutter(s) from an inner to outer radial position in accordance with the angular position of the drill bit. For example, by deploying the dynamic cutters over a 240° period, an eccentric channel about the longitudinal axis of the BHA, and parallel thereto, will be produced. As drilling progresses, a near bit stabilizer, located above and behind the dynamic cutters, contacts with the portion of well bore which was not removed with the dynamic cutters, i.e., the concentric part or pilot hole cut by drill bit cutters on the tip of the drill body. This contact exerts a force onto the near bit stabilizer which is reacted by the drill bit and another stabilizer or drill bit further up the drill string. The reaction force between the drill bit and the formation results in a side cutting force on the drill bit and hence deviation of the drill bit is achieved.

While the pilot hole is centered on the longitudinal and rotational axis of the BHA, the effective rotational center of the moveable cutters is displaced by radial extension of the moveable cutters so that the moveable cutters cut an eccentric hole displaced from the center of the pilot hole in the direction of the desired change of drilling direction.

A complete Bottom Hole Assembly (BHA) may comprise a drill bit of the type commonly used for drilling well bores, a directional drilling tool comprising a device according to an embodiment of the present invention and a series of either collars or other measurement tools. For the purpose of this description, all tools above the directional drilling tool will be simply known as collars. In one embodiment, the directional drilling tool comprises a plurality of movable cutters which are normally biased outwardly and moved between their respective inner radial positions and their outer radial positions in synchronism with the rotation of the BHA. Thus, as previously stated, by controlling the synchronous movement of the cutters in relation to the rotation of the drill string, an elongate arcuate channel will be produced behind the drill bit. That is to say the drill bit will cut a circular cross-section pilot hole and the movable cutter(s) a circular cross-section eccentric hole having a center offset slightly from the center of the pilot hole. As drilling progresses, the stabilizer, which has a larger radial diameter than the cutters, when the latter are in their inner radial positions, contacts the well bore. By controlling the orientation of the eccentric channel, with respect to the well bore, directional control of the well bore can be maintained. The drilling tool is directed in the direction of the eccentric channel cut by the cutters, that is to say the drilling tool is subsequently steered in the direction of the eccentricity defined by the axis of rotation of the cutters.

When using a drill having a cutting diameter of, say, 14 cms (centimeters), drill collars are typically of a length of about 10 meters and are coupled together by screw couplings. Though formed of robust materials such as steel they are flexible to an extent enabling approximately 3° per section. As a consequence, in this instance, approximately a minimum 300 meters of drill string length is required to negotiate a 90° turn in direction under the influence of the forces acting on the drill bit. For other drill diameter and end collar lengths, different considerations may apply.

In the embodiments described in UK patent application No. 0602829.4, it is possible that the region between the moveable cutters and the tool body could be subject to the accumulation of drilling debris, for example small pieces of rock which have been removed by the drilling process. There exists, at least theoretically, a possibility that the cutting debris could become packed in between the moveable cutters and the drilling tool body and thereby restrict movement of the moveable cutters. This could have an impact on the efficient operation of the directional drilling tool as the moveable cutters are required to move from their inner to outer radial positions in a synchronized manner with respect to the rotation of the drilling tool body, and are deployed at the same angular position with each revolution of the drilling tool body. It has been recognized that if the moveable cutters are restricted or even prevented from moving from their inner to outer radial positions steering control of the drilling tool may be impaired.

According to another aspect of the invention there is provided a directional drilling device for use in drilling boreholes, the device being positionable between a drill bit and associated drill collar of a drill string having a longitudinal drilling axis; the device comprising: at least one cutting member movably mounted with respect to a body member, the cutting member(s) being movable between a first radially extended position for engagement with the wall of a bore hole and a second radially retracted position, and means for directing pressurized fluid to the region between the body member and the cutter. Preferably, directional control means are provided for synchronizing the movement of the cutting member(s) between the respective extended and retracted positions in accordance with the rotational position of the body member in the bore hole being drilled. Preferably, at least one fluid exit port or nozzle is provided in the drilling tool body to direct pressurized drilling fluid from an internal passageway within the tool body to the region behind the moveable cutter or cutters. In this way, the exiting pressurized fluid provides a cleaning jet to flush away cutting debris that may otherwise gather between the body member of the drilling tool and the moveable cutter(s) and thereby prevent the build up of debris which may otherwise prevent the moveable cutter(s) returning to the retracted position.

In preferred embodiments at least one exit port or nozzle is provided per moveable cutter and preferably an internal passageway in the body member is provided for each moveable cutter for communicating high pressure drilling fluid from an interior passage within the tool body which also delivers drilling fluid to the drill tip end of the drill bit body.

According to another aspect of the invention, there is provided a directional drilling device for controlling the drilling direction of a rotary drill bit when drilling boreholes in subsurface formations; the device being positionable at or towards the end of a drill string for rotation with the drill string about a longitudinal drilling axis; the device comprising: a rotatable body including a drill bit or means for connecting a drill bit to the body at a down hole end thereof for rotation with the body about a longitudinal drilling axis; at least one directional cutting member movably mounted with respect to the body; the directional cutting member being movable radially with respect to the longitudinal axis of the body for engagement with the wall of a bore hole cut by the drill bit; and means for directing pressurized fluid to the region between the rotatable body and the cutting member.

The directional cutting members of the device disclosed in UK patent application No. 0602829.4 may also encounter significant lateral forces in use due to their interaction with the cutting members with the rock formation being drilled.

According to another aspect of the present invention, there is provided a directional drilling device for controlling the drilling direction of a rotary drill bit when drilling boreholes in subsurface formations; the device being positionable at or towards the end of a drill string for rotation with the drill string about a longitudinal drilling axis; the device comprising: a rotatable body including a drill bit or means for connecting a drill bit to the body at a down hole end thereof for rotation with the body about a longitudinal drilling axis; at least one directional cutting member movably mounted with respect to the body; the directional cutting member being movable radially with respect to the longitudinal axis of the body for engagement with the wall of a borehole cut by the drill bit such that the geometric center of the cutting member may be aligned substantially coincident with the axis of rotation of the body member or radially offset therefrom by relative radial movement such that the movable cutter is capable of following an eccentric path with respect to the body member and drill bit as the body member and drill bit rotate during drilling to selectively enlarge the bore hole cut by the drill bit; and, directional control means for synchronizing the radial movement of the cutting member in accordance with the rotational position of the body in the bore hole being drilled. Preferably, the cutting member comprises a cylindrical element disposed around the exterior of the body member. This aspect of the invention readily enables the directional cutting member to support relatively large lateral cutting loads in use.

The present invention relates to a directional drilling apparatus for use in the directional drilling of bore holes. In one embodiment the apparatus comprises a plurality of cutting elements movably mounted with respect to a rotatable body member, wherein the cutting elements are movable between first, radially retracted, positions and radially extended, positions for cutting. A rotary valve is provided for synchronizing the movement of the cutting elements between their respective extended and retracted positions in accordance with the rotational position of the body member in the bore hole being drilled. Control of the directional drilling system is affected by synchronized movement of the cutting elements from an inner to an outer radial position in accordance with the angular position of the drill bit. For example, by deploying the dynamic cutters over a 240° period, an elongate arcuate channel parallel to the longitudinal axis of the BHA will be produced. As drilling progresses a near bit stabilizer contacts with the portion of the well bore which was not removed with the dynamic cutters and this contact exerts a force onto the drill bit. The force causes the drill bit to cut sideways and hence deviation of the drill bit is achieved. Embodiments are disclosed in which means are provided for directing high pressure cutting fluid to the region between the cutting elements and the rotatable body to prevent the accumulation of cutting debris in that region that could prevent movement of the cutting elements. Other embodiments are disclosed wherein the cutting elements enlarge the pilot bore hole formed by the drill bit so that the cutting elements continuously engage the wall of the pilot bore hole. Another embodiment is disclosed in which a cutting ring is provided which can be moved eccentrically with respect to the longitudinal drilling axis of the rotatable body.

The above, and other aspects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
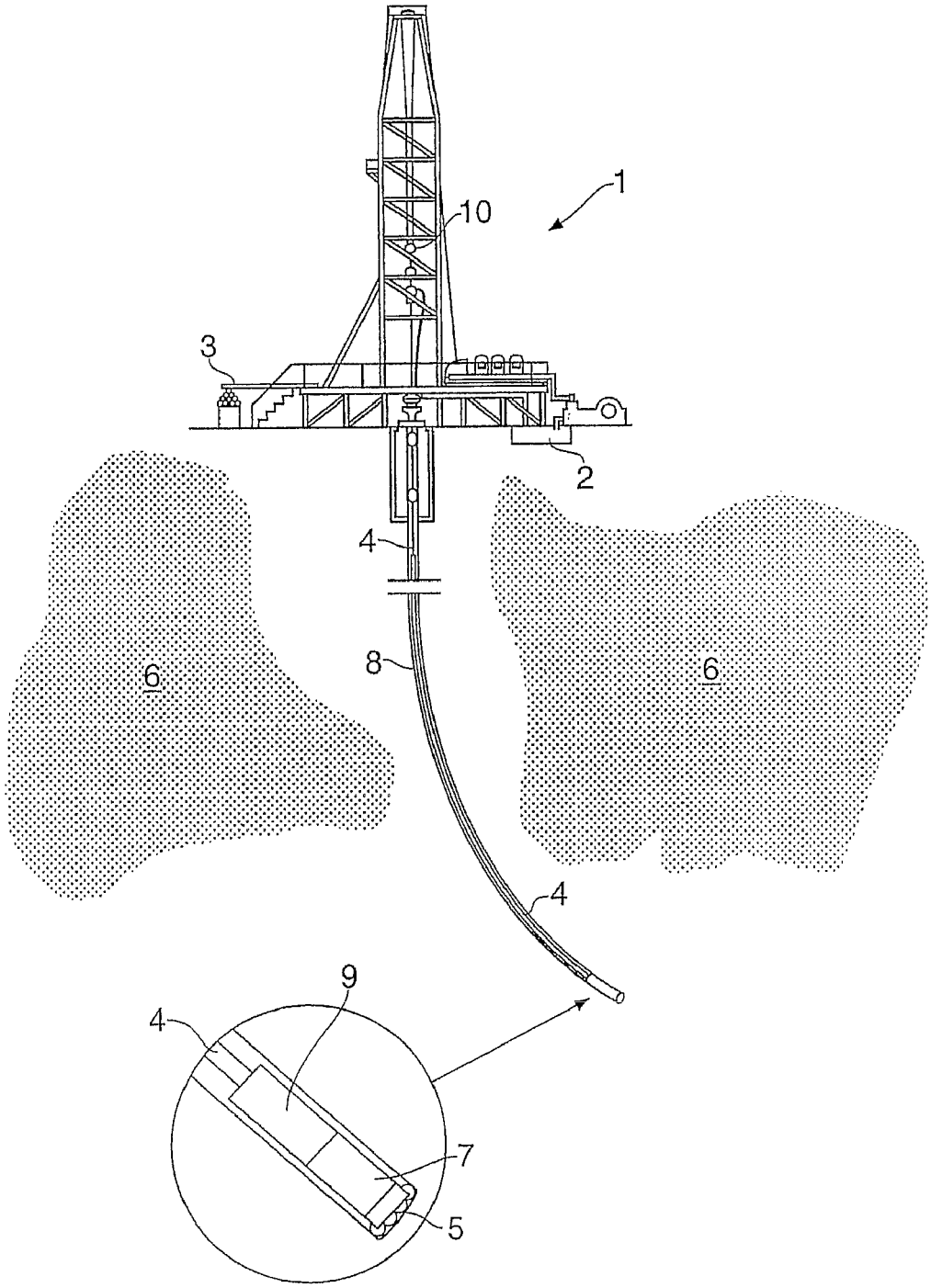
FIG. 1 is a schematic illustration of a deep hole drilling installation in which a directional drilling system is used.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring to FIG. 1, it is commonly used practice 1 in direction drilling to use a Bottom Hole Assembly (BHA) consisting of a drill bit 5 to cut the rock, a tool 7 to steer the drill bit and a measurement tool 9 to monitor the position of the resulting well bore. The BHA is connected to the surface through a series of pipes or collars 4 (known as a "drill string") and is rotated by either a rotary table or top drive which is part of the drilling rig 1. The drilling string is raised and lowered and weight-on-bit (WOB) is applied by controlling the draw works 10. A fluid is pumped from a storage tank 2 at the surface through a pipe 3 and into the drill string 4. The fluid travels through the drill string and exits through ports in the drill bit. This fluid then travels back to the surface on the outside of the drill string and back into the storage tank 2. As is well known in the art of drilling, fluid is used to lift the cuttings of rock produced by the drill bit back to the surface. The drilling fluid also cools and lubricates the drill bit and can be used as a source of hydraulic power for powering tools in the BHA.

Figure 2:
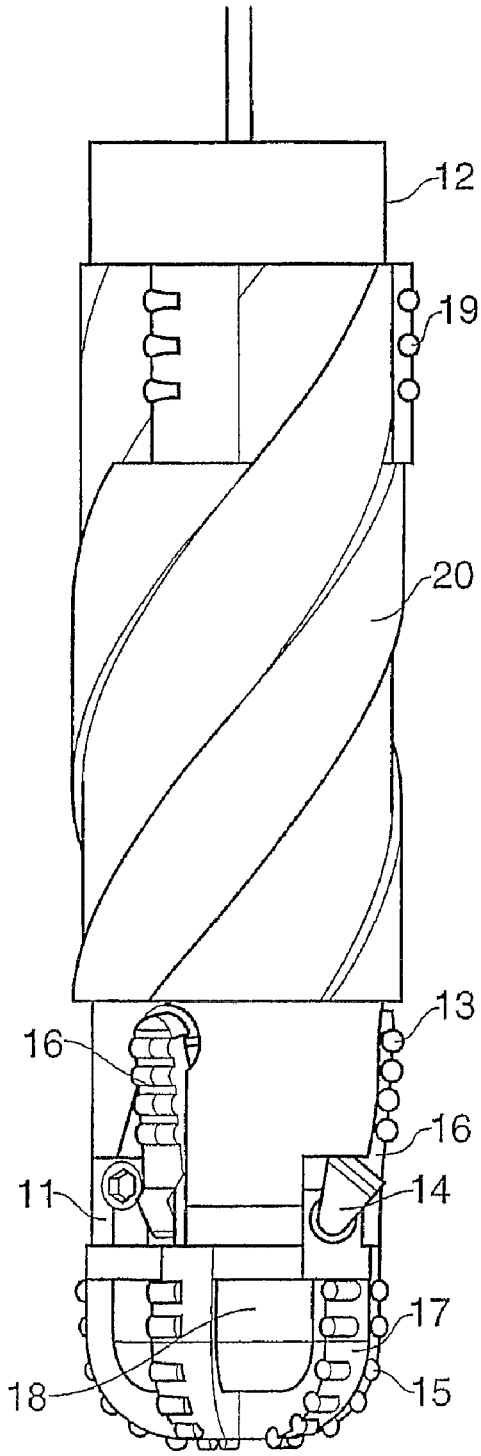
FIG. 2 shows a directional drilling system including a dynamic cutter of a device according to an embodiment of the present invention.

Referring now to FIG. 2, there is shown a directional drilling system according to a first embodiment of the present invention. A drill bit body 12 comprises a set of primary blades 17, attached to which, in a known manner, are super hard cutting elements 15 of a material such as polycrystalline diamond. Polycrystalline diamond (PCD) consists of a layer of diamond integrally bonded to a carbide substrate. The diamond layer provides high hardness and abrasion resistance, whereas the carbide substrate improves the toughness and weldability.

Adjacent to each blade 17 is a so called junk slot 18 to allow the passage of fluid and cuttings back to the surface. The drill bit body could have any number of blades and corresponding junk slots; the example shown consists of five equally spaced around the tip of the drill bit.

Cutting means, provided by a plurality or set of or dynamic cutters 16, is also provided which can be moved between radially inner, or retracted, positions to more radially outward, or outer, radial positions in a synchronised manner during rotation of the drill bit body. When in use, these cutters are normally biased, as explained below, in their radially outer, first positions. In a similar manner to the blades 17, elements 13 of super hard material are attached to the cutters 16 to cut the rock formation. The cutters pivot about a point 14 down-hole of their respective cutter face, that is to say at their end nearest the tip of the drill bit remote from the cutter face elements 13. Alternatively, the pivot point 14 could be higher or further up-hole than the cutting face. The drill bit body may contain any number of dynamic cutters equally spaced around the periphery of the drill bit body; in this example three are used. In an alternative embodiment, the dynamic cutters may also be spaced in a non-equal manner if required. The present invention also contemplates embodiments having only a single dynamic cutter 16.

The movable or dynamic cutters 16 are inserted into respective mounting holes in the drill bit body, described in more detail below, which prevent vertical and lateral movement of the cutters. The cutters 16 are prevented from falling out of their respective holes by a stop block 11 (FIG. 3) which is attached to the drill bit body.

A near bit stabilizer comprising a series of helically-formed blades 20, as is commonly used in directional drilling tools, is attached to the drill bit body 12. In this example the near bit stabilizer is shown with three helically-shaped blades. A set of gauge cutters 19 is mounted on the radially outer surface of the near bit stabilizer, towards the end of the drill bit body remote from the drill bit tip, to finish or gauge the hole diameter. The gauge cutters 19 could also be mounted elsewhere on the drill bit body in a known manner. The near bit stabilizer has an internal thread (not shown) for threaded engagement with an external thread (not shown) on the drill bit body 12.

Figure 3:
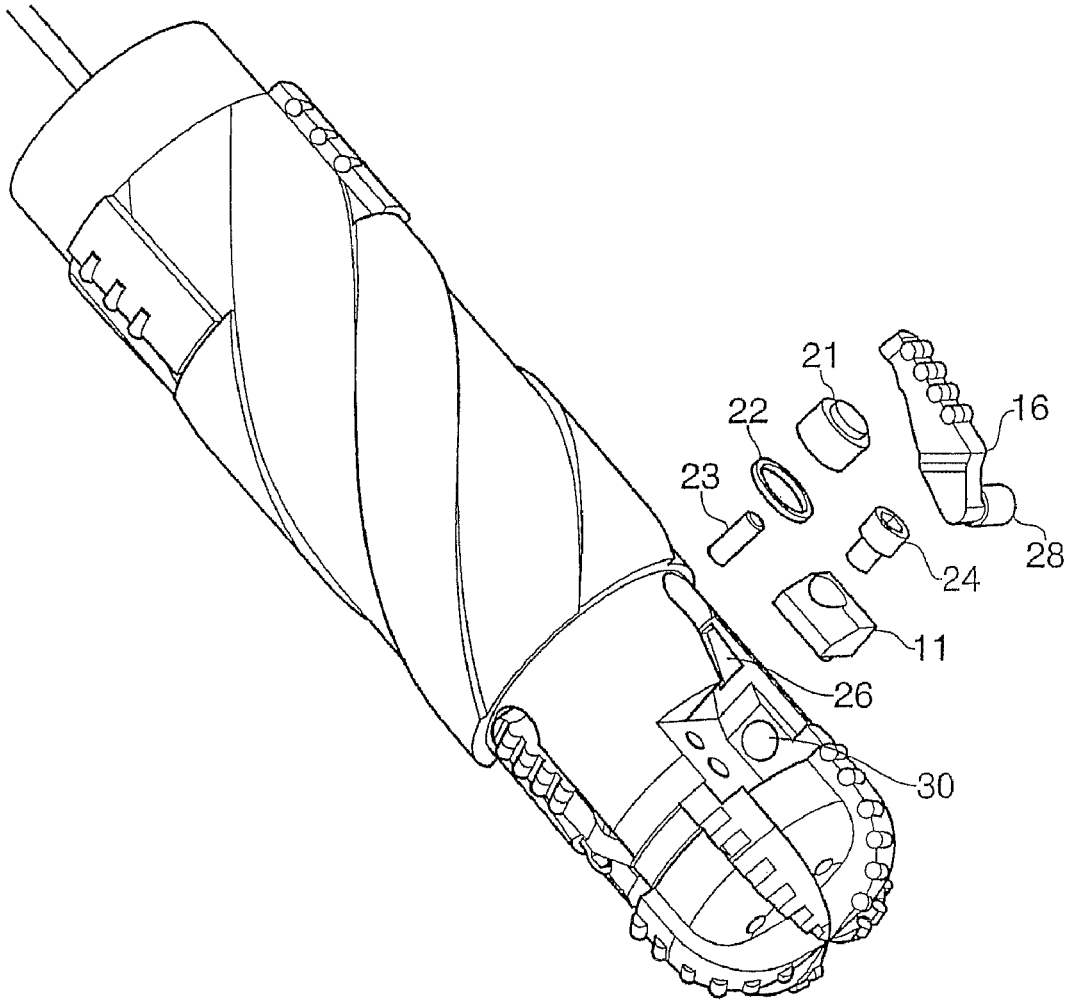
FIG. 3 is a part exploded detailed perspective view of the direction drilling system and dynamic cutter of FIG. 2.

FIG. 3 shows an exploded view of one of the dynamic cutters 16 and associated component parts. As previously described, the dynamic cutters 16 are each pivotally mounted on the drill bit body. The dynamic cutters 16 are each provided with a circular cross-section cylindrical stub shaft 28 which projects perpendicularly from the main body portion of the cutter. The stub shaft 28 is received in a cylindrical bore locating hole 30 in the drill bit body. A hard wearing material is preferably used on either the dynamic cutter pivot shaft 28 or drill bit body locating hole 30 to reduce wear due to relative movement of these components in use. The pivot locating hole 30 could also consist of a soft sacrificial sleeve. The retaining block 11 is fastened to the drill bit body by means of a threaded fastener 24, which may be a bolt. The dynamic cutter locating hole 30 and retaining block 11 prevent all lateral movement of the dynamic cutter with respect to the drill bit body.

Each dynamic cutter 16 is, when in use, biased to its first, outer, radial position by a respective piston 21. The piston comprises a blind bore 100 (FIG. 6) which receives a guide pin 23 attached at one end to the drill bit body in a known manner, for example by means of a compression fit. The piston 21 is slidably mounted on the other end on the guide pin 23 for movement along the pin in a cylinder type cavity 44 in the drill bit body. A piston seal 22, described in more detail below, is located in a circumferential slot in the cylinder wall in the drill bit body. The seal 22 prevents fluid escaping past the piston.

Radial movement of the dynamic cutter about its pivot axis 14 is restricted by contact with a cut out portion 26 in the drill bit body and the dynamic cutter retaining stop 29 (see FIG. 4) when the cutter is at its maximum deployed position. The dynamic cutter is returned to its second, inner, radial position due to the vertical weight on bit (WOB) force acting on the cutter. Additional assistance could be provided by mechanical means such as a return spring or springs to return the cutter to its retracted position when the hydraulic pressure acting on the piston is removed. An alternative embodiment of the present invention, discussed hereinafter with reference to FIG. 6A, provides for use of hydraulic pressure to assist in returning the cutter to its second, radially-inner, position.

Figure 4:
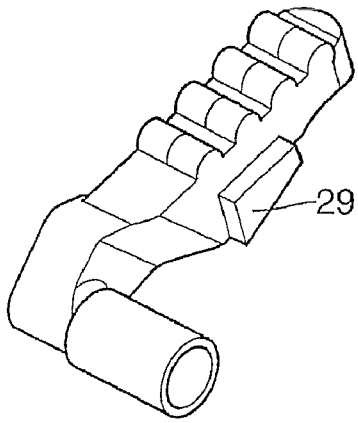
FIG. 4 shows a dynamic cutter blade of the dynamic cutter of FIGS. 2 and 3.

FIG. 4 shows one of the dynamic cutters 16 in more detail showing a radial movement limit stop 29 on the same side of cutter as the pivot mounting shaft 28. The stop 29 is arranged to contact a similar sized cut out 26 in the drill bit body to limit the extent of the pivotal movement of the cutter when deployed.

Figure 5:
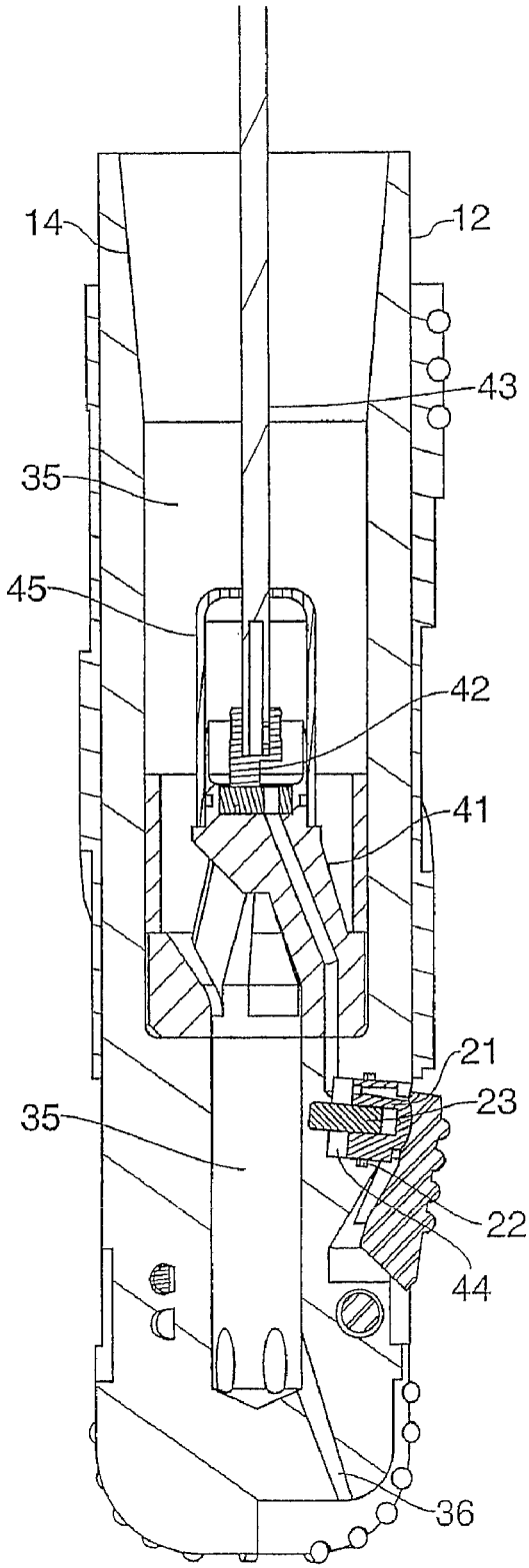
FIG. 5 is a cross-section view of the drilling system and dynamic cutter of FIGS. 2 and 3.

FIG. 5 is a cross-section view through the longitudinal axis of the drill bit body 12. An up hole connection 14 is shown for connection of the drill bit body to another drilling tool, for example a measuring tool. The drill bit body comprises a central through passage 35 for the passage of drilling fluid through the tool to the down-hole end of the drill bit body where it exits the tool. As is commonly known nozzles or restrictors can be inserted into the bottom of the drill bit body to restrict the flow rate of fluid through the tool and create a high pressure zone within the drill bit body and a low pressure zone outside the drill bit body. The drill bit body according to the illustrated embodiment comprises a plurality of nozzles 36 at the drill tip end of the drill bit body.

As previously mentioned, the movable cutters 16 are deployed from their second inner, positions to first, radially-outer positions by respective pistons 21 which are guided on pins 23 attached to the drill bit body. A rotary disc valve 42 is provided for diverting a portion of the fluid in the passage 35 to the piston chamber cavities 44 behind the respective pistons to deploy one or more pistons from their inner to outer radial position. The pistons use the relative high pressure of the fluid in the drill string entering the passage 35 as a source of hydraulic power. A filter 45 located at the downstream end of the passage 35 is used to remove particles from the fluid before that fluid can enter the valve 42, to prevent damage to the piston seals.

As previously mentioned, in use, direction control is achieved by the synchronous deployment of the dynamic cutters 16 from their inner to outer radial positions as the drill bit body rotates. The pistons are deployed by controlling the fluid flowing to them using the rotary disc valve 42 which is controlled by and attached to a shaft 43 extending along the longitudinal axis of the drill bit body from the valve 42 and passing through the upstream end of the drill body. A fluid distributor 41 is used to divert the fluid from the disc valve to the pistons in dependence on the angular position of the disc valve 42 with respect to the distributor.

In operation, the cutters 16 are normally deployed in their first, radially-outer positions so that they effectively enlarge the bore behind the drill bit. In this mode of operation, they are held in their radially-outer positions by hydraulic fluid supplied under pressure via the rotary valve 42. In this mode of operation, the valve 42 rotates 'out of phase' with the drill so that the cutters operate on the entire wall of the bore as they rotate. The cutters move in and out between their first and second positions but not in synchronization with rotation of the drill itself. In consequence they act to enlarge the bore behind the drill itself.

However, when required to assist re-direction of the drilling axis, the rotational position of the rotary valve with respect to the drill is set by rotating the valve relative to the drill by means well known in the art, for example, a roll stabilized electronics platform or a strapped down electronics system could be used with an electric motor providing the rotational control for the rotary disc valve control shaft. In this way hydraulic fluid is only supplied to the pistons 21 during a fixed part of the rotation of the drill so that all of the cutters operate only on the same sector of the wall of the bore as the drill descends such that the dynamic cutters define an eccentric cutting axis offset from the main drilling axis of the drill. This is achieved by holding the rotary valve 42 geostationary once the valve has been rotated to an angular position within the bore hole being drilled. This angular position is determined by the direction in which the drill string is to be steered.

Figure 6:
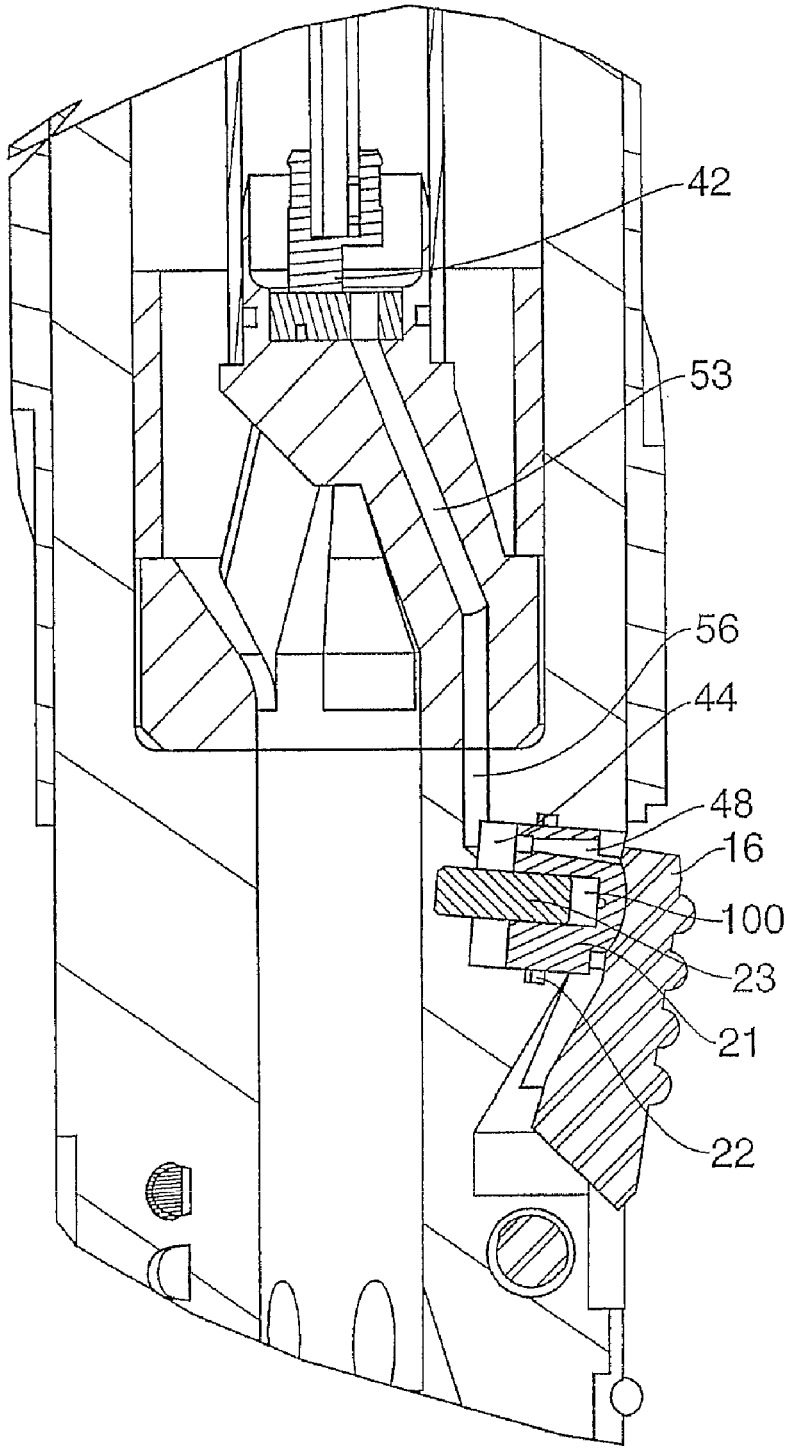
FIG. 6 is a detailed view of the dynamic cutter of FIG. 2 which shows a dynamic cutter deployed in an outer radial position.
Figure 6A:
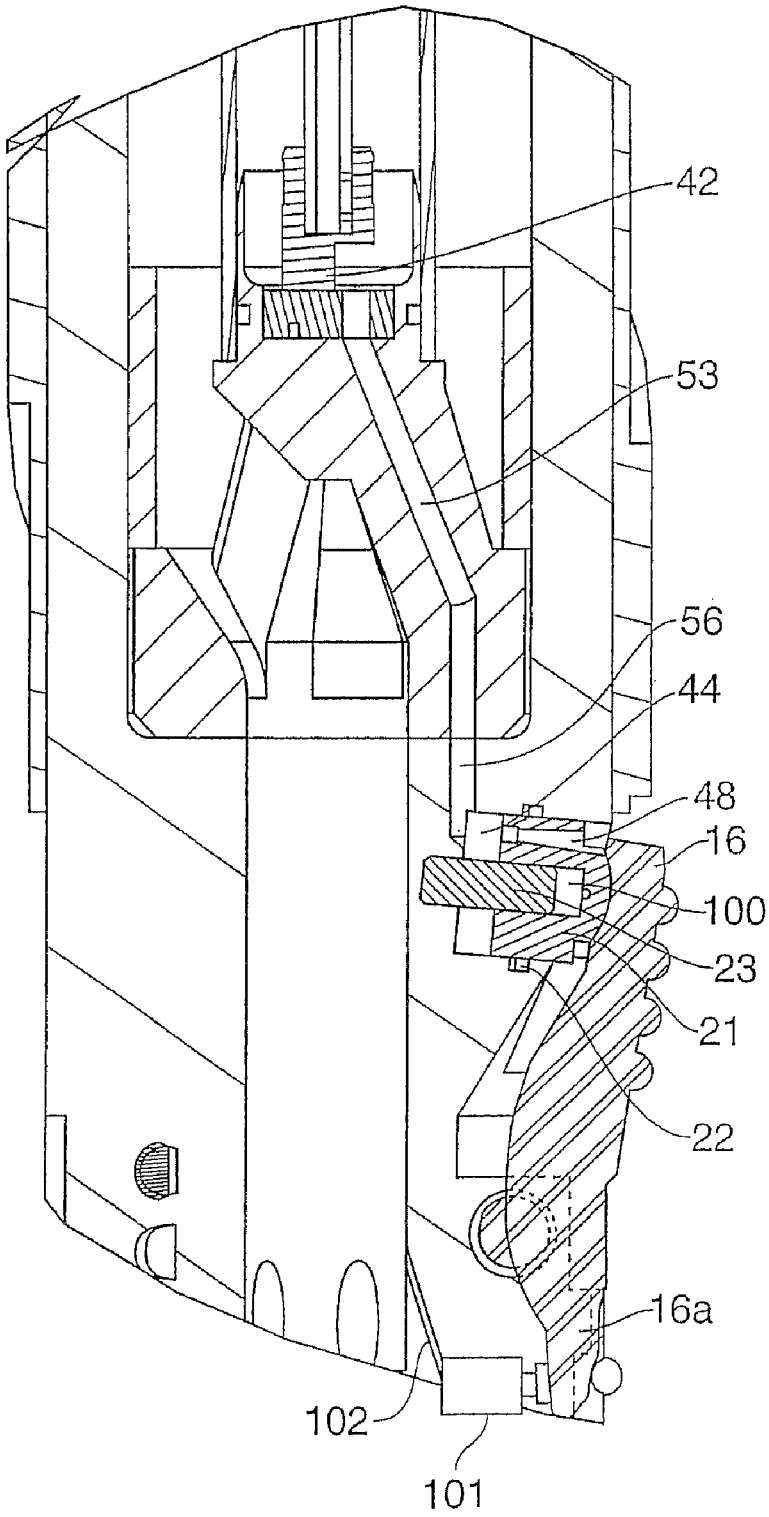
FIG. 6A is a detailed view, similar to that of FIG. 6, showing another embodiment of the invention in which means is provided for urging a dynamic cutter to a retracted inner radial position.

Referring now to FIG. 6, this shows the manner in which the disc valve 42 operates; the disc valve 42 is in the open position for the cutter 16 shown in the drawing. In this position, the valve 42 allows the communication of fluid through the disc valve into a feed port 53 in the fluid distributor, then into a feed port 56 in the drill bit body and then into the cavity 44 behind the piston. The pressurized hydraulic fluid pushes the piston 21 forward on the guide pin 23 which causes the dynamic cutter 16 to be moved from its second, radially inner, position (FIG. 7) to its first radially-deployed, outer position (FIG. 6). The piston guide pin 23 is attached to the drill bit body in the centre of the cavity 44 between the drill bit body and the piston. The piston continues to move in the radial direction until the dynamic cutter contacts the limit stop as previously described. In this position the dynamic cutter's radial position is greater than the radius of the stabiliser blade 20.

The piston seal 22 is located in the drill bit body. This seal 22 may be of an o-ring design, a lipped design with a leading or trailing lip or both or any other known type of seal. An exit port 48 is provided in the piston extending from one end of the piston to the other to allow the hydraulic fluid to pass from the cavity 44 to the exterior of the drill bit body. This also enables the piston to return to its inner radial position once the rotary disc valve 42 is closed. The diameter of the exit port 48 is less than the diameter of the feed port 53 in order to create a pressure differential across the piston. In an alternative embodiment, this hydraulic system could also be used without the piston seal 22, such that the fluid exits past the piston. In such an arrangement the exit port 48 may not be required.

Figure 7:
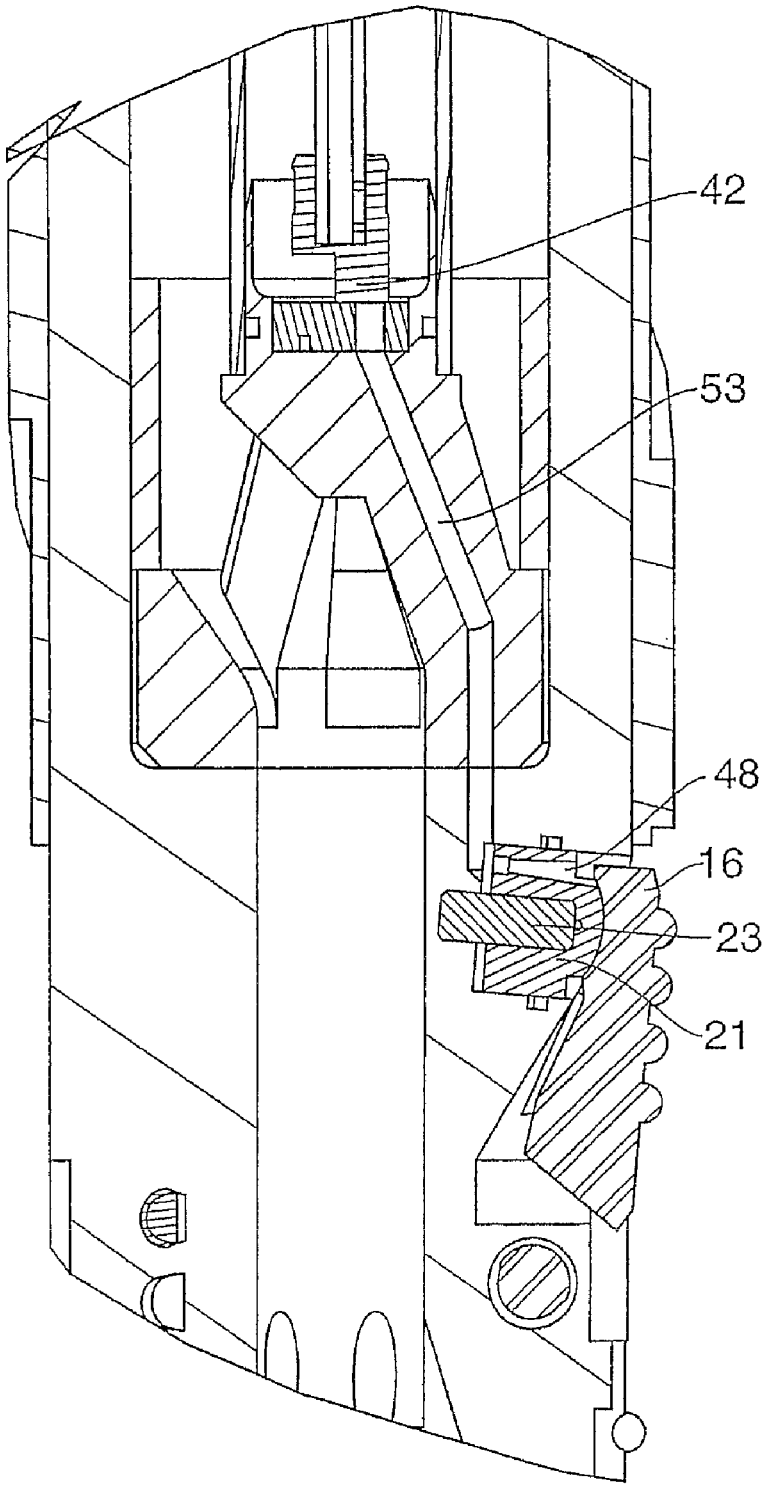
FIG. 7 is a detailed view of the dynamic cutter of FIG. 6 which shows a cutting blade retracted to an inner radial position.

FIG. 7 shows the dynamic cutter 16 in the radially-inner position. When the disc valve 42 rotates relative to the drill bit body there is a period during which the flow of fluid to the feed port 53 is stopped and the fluid in the cavity vents to the low pressure zone outside the drill bit body through the piston exit port 48. The dynamic cutter 16 and piston 21 are returned to the radially-inner position of FIG. 7. In order to advance the hole being drilled, the drilling tool is pressed into the rock formation with a force commonly known as weight-on-bit (WOB). This results in a reaction force between the drill bit cutters and the rock formation. Similarly a reaction exists between dynamic cutters and the rock formation. When the disc valve 42 closes, this reaction force will cause the dynamic cutter to return to its inner radial position. The inner radial position is controlled by engagement of the piston 21 with the guide pin 23 and engagement of the dynamic cutter 16 with the piston 21. In this position the outermost radial point of the dynamic cutter is less than the stabilizer radius. The dynamic cutter will remain in this position until the rotary disc valve 42 returns to the open position.

Figure 7A:
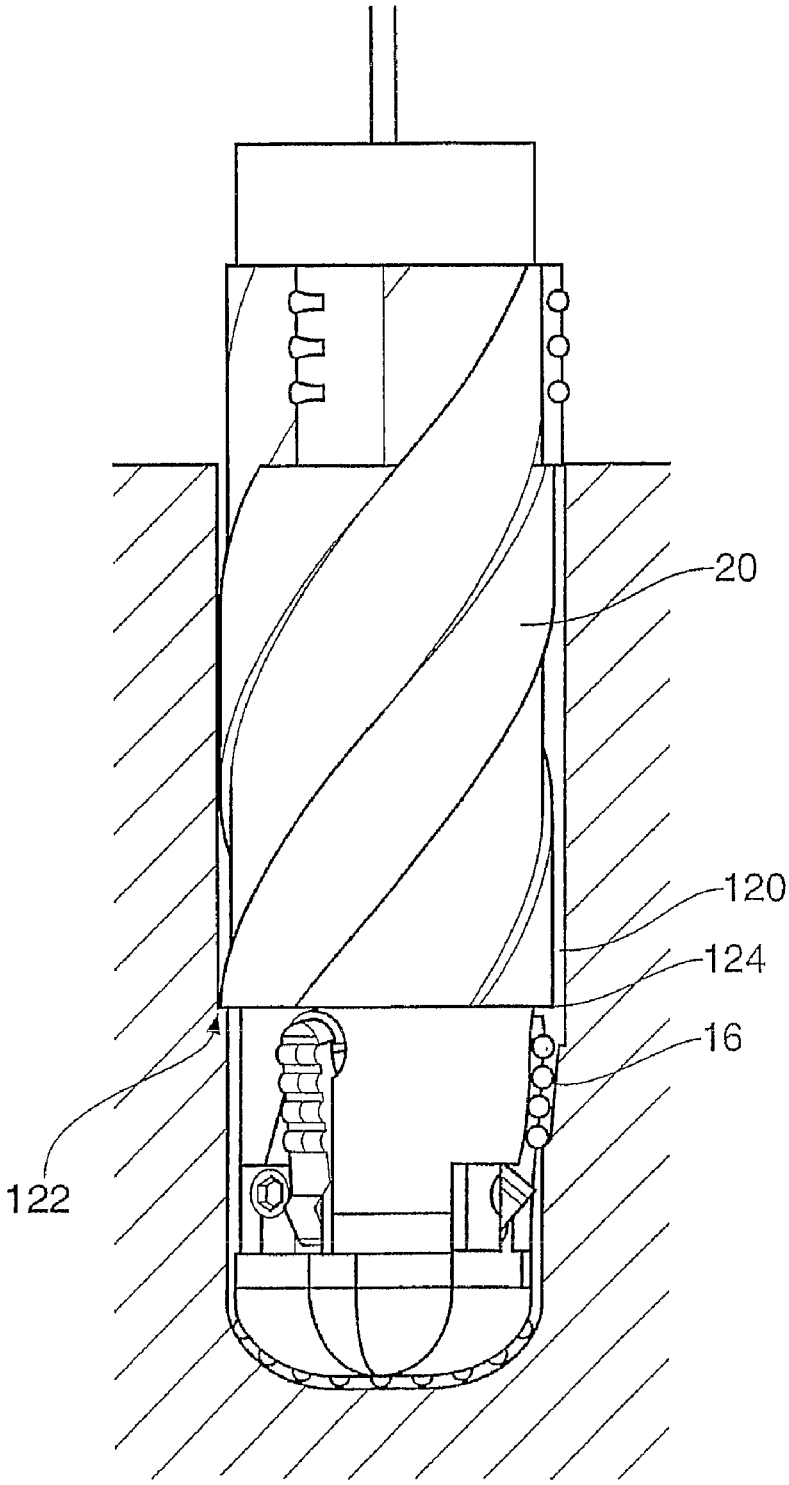
FIG. 7A is a schematic view of a bore hole being drilled with a directional drilling system according to an embodiment of the present invention.

FIG. 7A illustrates schematically the manner of operation of a directional drilling device and tool according to the present invention to re-direct a drill head. This drawing is not to scale and simply illustrates the manner in which the device is influential to effect re-direction of the drill head.

When it is desired to change the direction of drilling, the rotational position of the disc valve 42 is adjusted relative to the drill bit body for eccentric cutting as previously described.

In one example of a typical drill, the cutting diameter of the cutting elements 15 defines a bore of approximately 14 cm (5.5 inches), while the cutters 16, when extended, can cut a channel in a defined arcuate sector 120 from the bore wall at a maximum distance from the axis of rotation of the drill of about 7.6 cms (3.0 inches). Depending upon the disposition of the cutters 16, such a sector 120 will effectively be crescent shaped when viewed in plan (i.e. normal to the axis of rotation).

The stabilizer 20, following the cutters 16 has an external cutting diameter, which lies between that of the drill head and the maximum cutting distance of the cutters 16 at 14.6 cms (5.75 inches).

It is to be clearly understood that these dimensions are not intended to be limitative of the invention and serve only as an example.

When the drill is descending linearly, the forces and their reactions acting on the drill head are evenly distributed around the drilling axis and do not affect the linear progress of the drill head. When it is desired to re-direct the drilling axis, a segment or sector 120 of the bore wall is removed by the cutters 16 as previously described. As drilling progresses a near bit stabilizer, located above and behind the dynamic cutters, contacts with the portion of well bore which was not removed with the dynamic cutters, i.e. the concentric part. This contact exerts a force onto the near bit stabiliser which is reacted by the drill bit and another stabiliser further up the drill string. The reaction force between the drill bit and the formation results in a side cutting force on the drill bit and hence deviation of the drill bit is achieved.

The movable or dynamic cutters 16 are, as will be appreciated from the above, deployed in their extended positions in synchronization with rotation of the drill until the required angle of deviation has been achieved. The deviation can be measured by measuring devices 9 in the drill string to the rear of the drill bit.

Figure 8:
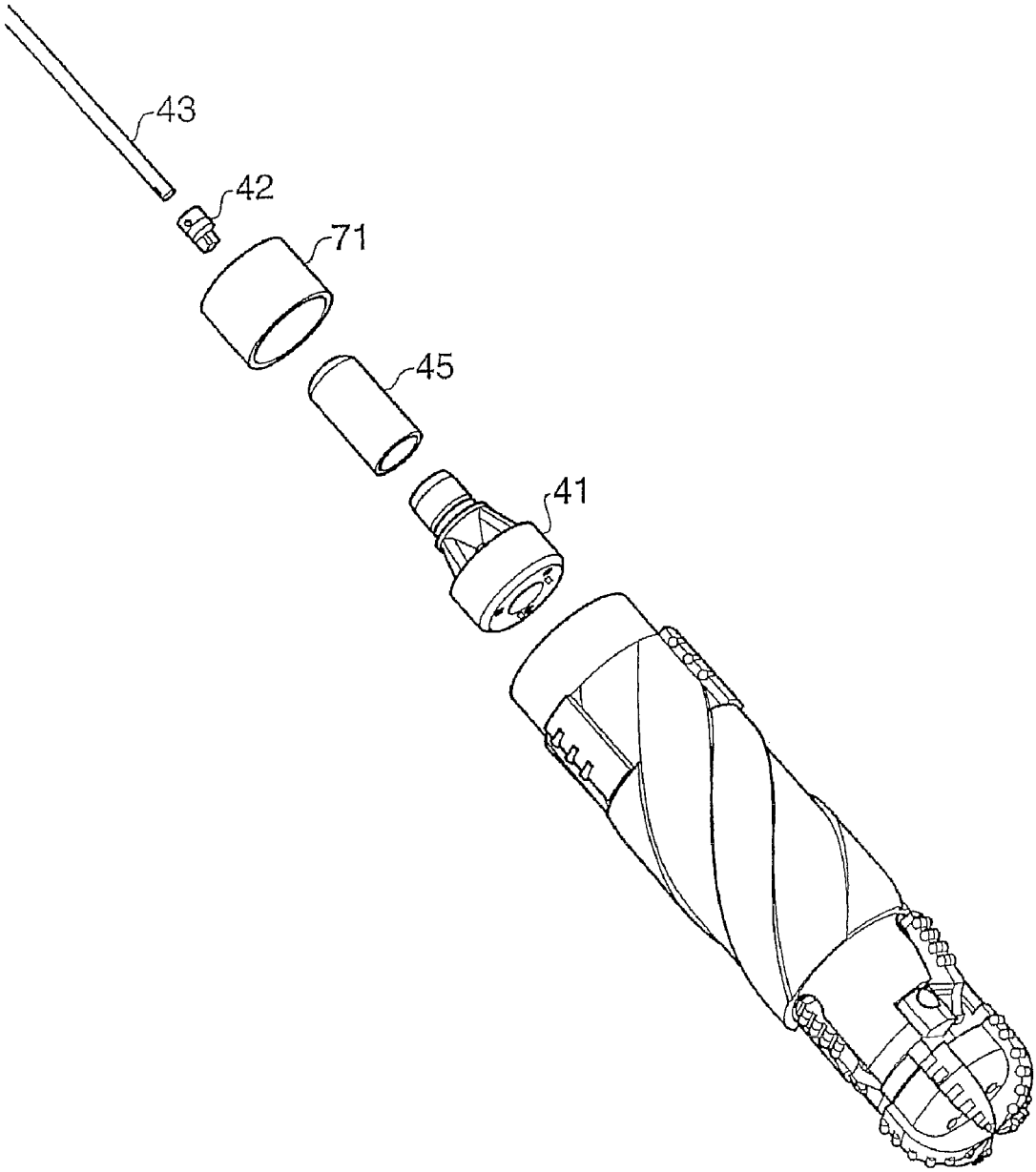
FIG. 8 is an exploded view of the directional drilling system of FIGS. 2 to 7 showing a control valve, filter and fluid distributor of the drill bit.

FIG. 8 shows an exploded view of the fluid distributor 41, filter 45, rotary disc valve 42 and control shaft 43. The fluid distributor 41 is held in place, that is to say is fixed with respect to the drill bit body, by a locking ring 71 which has an external thread (not shown) which engages an internal thread (not shown) in the drill bit body. The filter 45 has an internal thread (not shown) which engages an external thread (not shown) on the fluid distributor 40. The rotary disc valve 42 is attached to the valve control shaft 43 by a keyway or other known arrangement.

Figure 9:
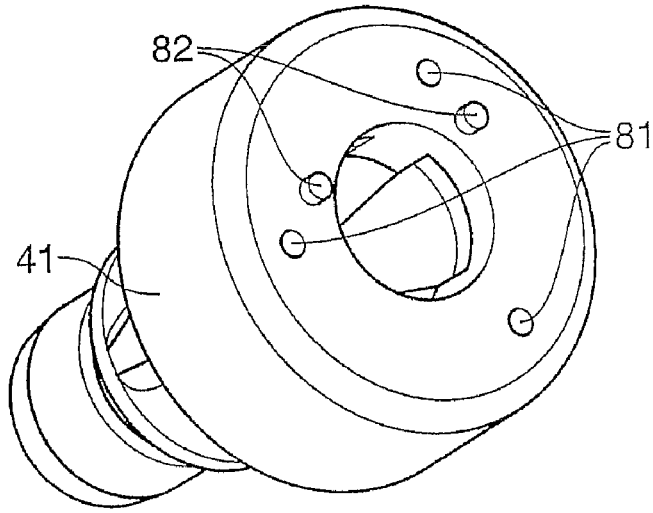
FIG. 9 is a detailed perspective view of the rotary disc valve and fluid distributor shown in FIG. 8.
Figure 10:
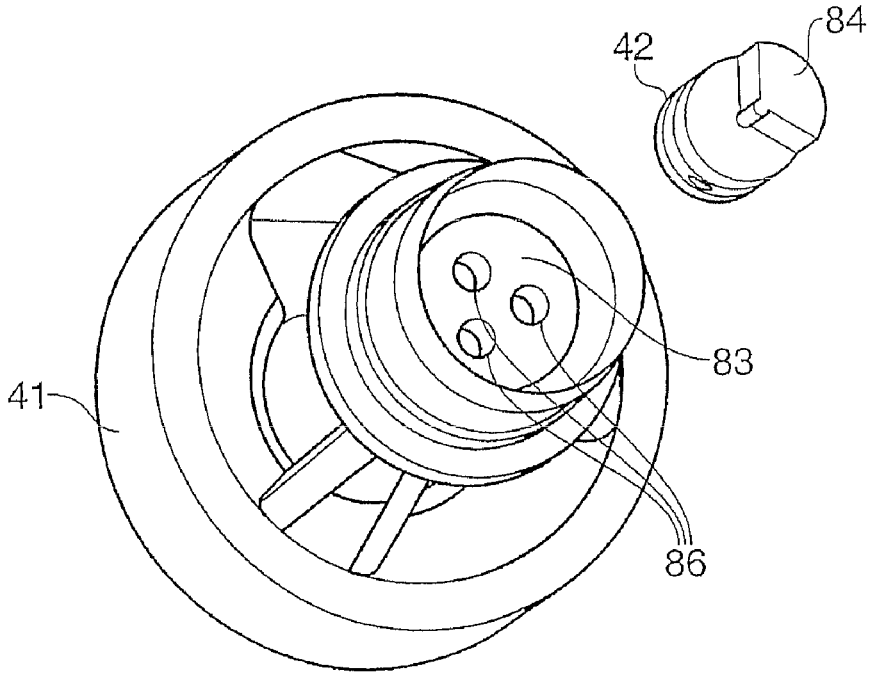
FIG. 10 is a detailed perspective view of the rotary disc valve and fluid distributor shown in FIG. 8.

Referring to FIGS. 9 and 10 which show the fluid distributor 41 and rotary disc valve 42, the fluid distributor 41 comprises a series of feed ports 81 corresponding to the number of dynamic cutters 16 on the drill bit body. The feed ports are located in the end face of the fluid distributor at the end of the respective internal fluid communication passages 53. In this example, three are shown. The feed ports 81 are used to channel the hydraulic fluid from the rotary disc valve to the feed ports 56 in the drill bit body. Two pins 82 are provided for engagement with two corresponding holes (not shown) in the drill bit body to ensure the feed ports in the fluid distributor are aligned angularly with the feed ports in the drill bit body when assembled together.

FIG. 10 shows the rotary disc valve 42 and fluid distributor 41. When assembled together the rotary disc valve face 84 contacts the feed port face 83, that is to say, in FIG. 10, the valve 42 has been rotated 180° degrees from its normal orientation with respect to the fluid distributor to show the detail of the end face 84 which, in its assembled position, engages the end face 83 of the distributor 41. The diameter of the cylindrically shaped valve 42 is less than the internal diameter of that part of the distributor in which it is located so that fluid may pass between the outer periphery of the valve 42 and the inner circumference of the upstanding cylindrical pivot of the distributor in which the valve is located. This is best shown in the cross-section views of FIGS. 6 and 7. In use, fluid flows around the outside periphery of the rotary disc valve 42 and into those ports 86 which are not closed off by the rotary disc valve face 84. As the rotary disc valve 42 rotates with respect to the drill bit body each successive port will be closed off in turn and fluid allowed to enter the two remaining ports. The mating surfaces of the port face 83 and rotary disc valve face 84 could be coated in a hard wearing material or manufactured from polycrystalline diamond in order to reduce wear. The rotary disc valve is shown with an open period of 240 degrees. Therefore with each rotation of the drill bit body the dynamic cutters are displaced radially outwards for 240 degrees of each rotation and are retracted for the remaining 120 degrees of rotation. The opening period could be more or less than this depending on the shape of the eccentric hole to be produced by the dynamic cutters.

As previously described the rotary disc valve is required to open and close to allow fluid within the drill string to flow to the pistons in the drill bit body, including any restraining pistons provided to limit the effect of the primary pistons. When operating synchronously with rotation of the drill, the rotary disc valve is required to open and close at the same angular position with each rotation of the drill bit body in order to deploy the dynamic cutters at the same angular position with each rotation of the drill bit body. This is achieved by holding the rotary disc valve geostationary about the rotating drill bit body. Therefore, as the drill bit body rotates, a piston feed port 53 will rotate and become open allowing the fluid to flow to the piston cavity. As the drill bit body continues to rotate, the feed port will remain open for 240 degrees of rotation when the disc valve will shut off the flow to that piston. In the meantime another feed port will appear and allow fluid to flow to the next piston and so on.

In an alternative embodiment of the invention shown in FIG. 6A, a secondary piston-and-cylinder arrangement 101 may be provided for acting on a respective dynamic cutter to limit outward movement about the pin 28 and to assist in rapid movement of the cutters from their radially outer first positions to their second, radially inner, positions. By way of example, the secondary piston-and-cylinder arrangement 101 may act on a shoulder 16A of an extended form of the cutter 16 or other part adapted to engage such piston. Such a piston would act continuously to counterpart of the force exerted by the piston 21. The secondary piston-and-cylinder arrangement is, in operation, permanently biased against the shoulder 16A so that during those periods when the cutter is not subjected to biasing pressure, it can be active to move the cutter instantly to its second, inner, radial position. The bias of the piston is provided by hydraulic pressure of fluid in the string ducted through or past the valve 42 permitting supply of hydraulic fluid direct to the cylinder of the arrangement 101 via a conduit 102.

Figure 6B:
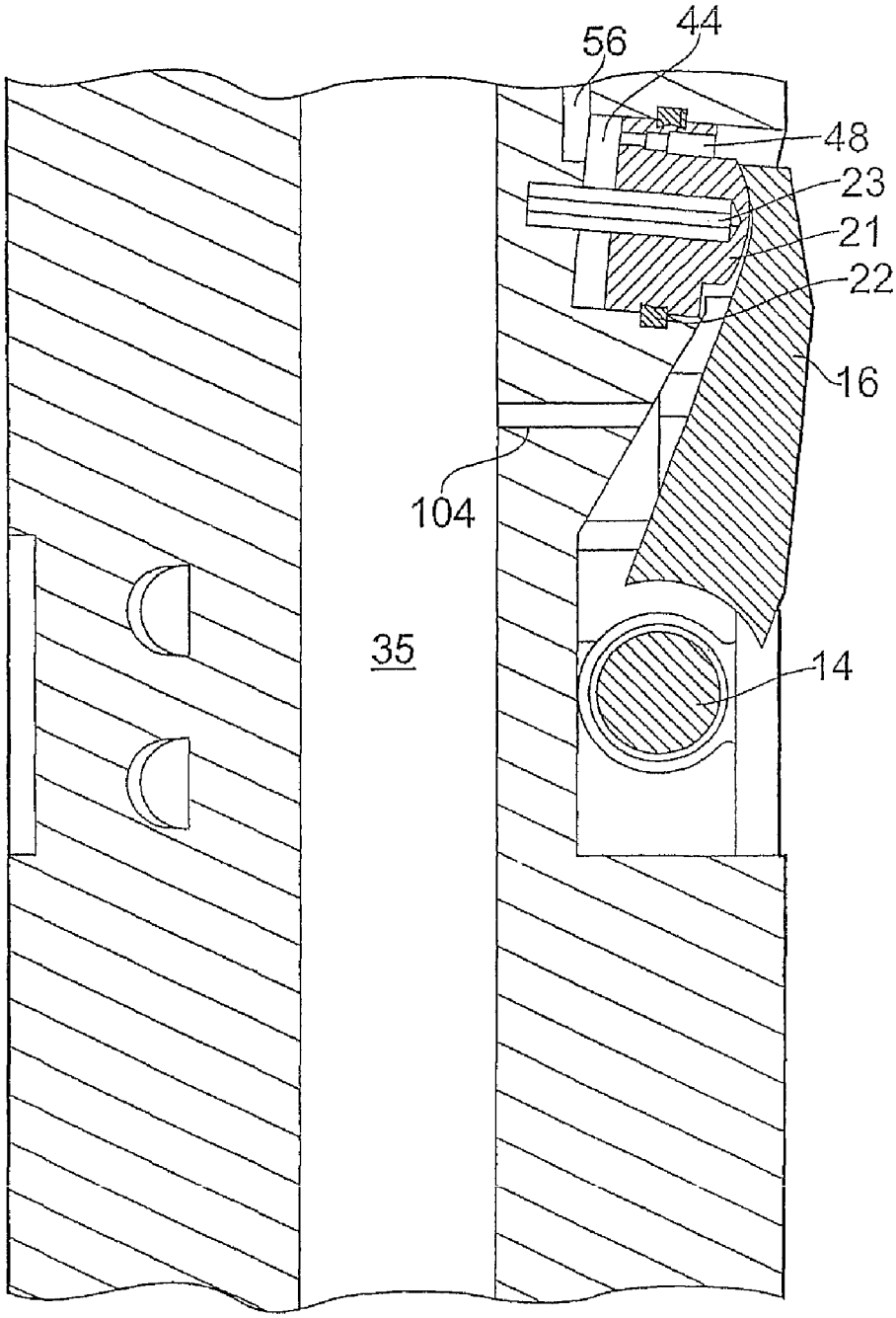
FIG. 6B is a detailed view similar to FIGS. 6 and 6A of a further embodiment of the invention.

Referring now to the embodiment shown in FIG. 6B, only part of the drill bit body is shown, that is the longitudinal portion of the drill bit body comprising the movable cutters. In the modified embodiment of FIG. 6B, an internal passageway or gallery 104 is provided in the drill bit body between the central passage 35 and the exterior of the body for communicating high pressure drilling fluid, which is contained in the central passage 35 during drilling, to the exterior of the body in the region between the body and the movable cutter 16. This arrangement is similar to that shown in the drawing of FIG. 5 where nozzles 36 at the drill tip end of the body are provided for delivering cutting fluid to the primary blades 17. The internal passage 104 has an exit port on the exterior of the body which may have the same cross sectional dimensions as the passage 104 or smaller depending on the particular design requirements for flow rate, pressure etc. As shown in the drawing of FIG. 6B, the passage 104 is located between the piston 21 and the pivot 14 of the movable cutter but of course the exact positioning of the passage will depend on the particular design considerations. It is to be understood that one or more passages 104 may be provided per movable cutter 16 and in the embodiment shown in FIG. 6A it may be desirable to provide at least one internal passage 104 on both sides of the pivot 14 in the longitudinal direction of the body.

Figure 12:
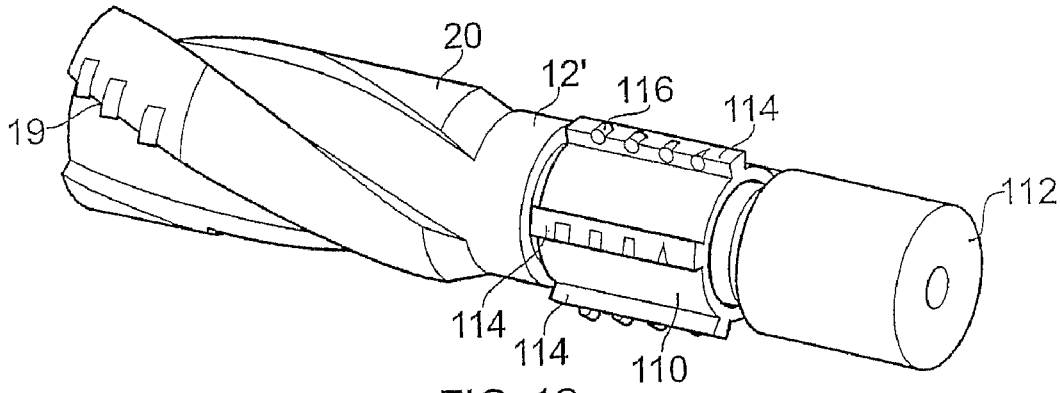
FIG. 12 is a perspective view of a directional drilling system including a dynamic cutter of a device according to another embodiment of the present invention.

Referring now to FIG. 12 which shows a modified embodiment of a directional drilling device of the present invention. In this embodiment the three movable cutters 16 of the previously described embodiments are replaced by a movable cylindrical cutter 110 disposed around a modified cylindrical body portion 12'. The directional drilling device of FIG. 12 is similar to the previously described arrangements in that it comprises a near bit stabilizer 20, gauge cutters 19 and a down hole end 112 for connection to a drill bit. The movable cutter 110 comprises a cylinder having a plurality of equally spaced radial projections 114 which extend from the external radially outer surface of the cylinder, longitudinally from one end of the cylinder to the other. The projections 114 are each provided with a plurality of cutting elements 116, for example PDC elements. The cylindrical cutter 110 is movable radially with respect to the body portion 12 such that its longitudinal axis may be aligned coaxially with the axis of rotation of the body portion 12', and thereby the drill bit attached to the end 112, or offset from the axis of rotation so that the geometric centre of the cylindrical cutter 110 is eccentric to the drilling axis of rotation of the body portion 12' with which the movable cutter 110 rotates.

Figure 13:
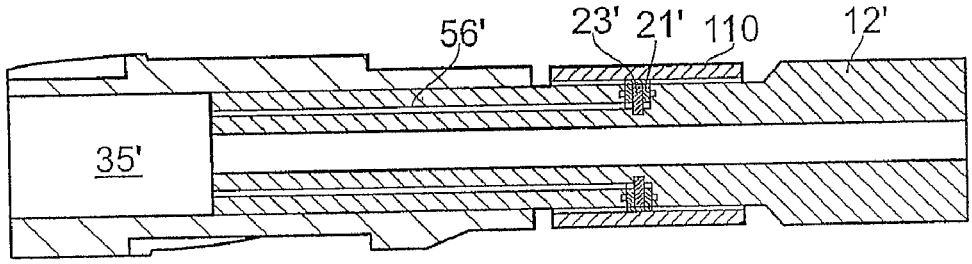
FIG. 13 is a cross-sectional view of the device of FIG. 12 in a plane along the longitudinal axis of the device.

Referring now to FIG. 13, which shows the internal arrangement for moving the movable cutter 110 with respect to the body portion 12', there is shown a plurality of hydraulic galleries 56' which are circumferentially spaced around the body portion 12 for feeding hydraulic fluid from a fluid distributor and disc valve arrangement (not shown) in the up hole region of the central bore 35' to respective pistons 21' disposed circumferentially around the periphery of the body portion 12'. As can best be seen in the drawing of FIG. 14, eight pistons 21' are equally spaced around the periphery of the body portion 21' in the region of the movable cylindrical cutter 110 so that the magnitude and direction of the eccentric offset of the longitudinal axis of the cutter 110 can be varied with respect to the longitudinal axis, and hence rotational axis, of the body 12' and drill bit when attached to the end 112 thereof. The hydraulic pistons 21' are similar to those arrangements previously described in that the pistons are mounted on respective guide pins 23' for movement in respective cavities 44'. It will be understood that by selective pressurization of the respective pistons the longitudinal axis of the cutter cylinder 110 may be varied with respect to the rotational axis of the body portion 12'. By utilizing a similar disc valve and fluid distributor arrangement as previously described pressurization and depressurization of the respective pistons may be synchronized so that the cutting elements 116 are capable of operating in the same way as the movable cutters 16 in the previous embodiments to cut an arcuate sector in the bore wall previously cut by the drill bit attached to the end 112 of the body portion 12'. Although not shown in the drawings of FIGS. 13 and 14 the directional drilling device comprises transmission means for transferring torque from the rotating body portion 12' to the cylindrical cutter 110. This may be achieved by a spline coupling arrangement or the like having sufficient radial clearance for the required movement in the radial direction of the cylindrical cutter 110 with respect to the body portion 12'.

Figure 14:
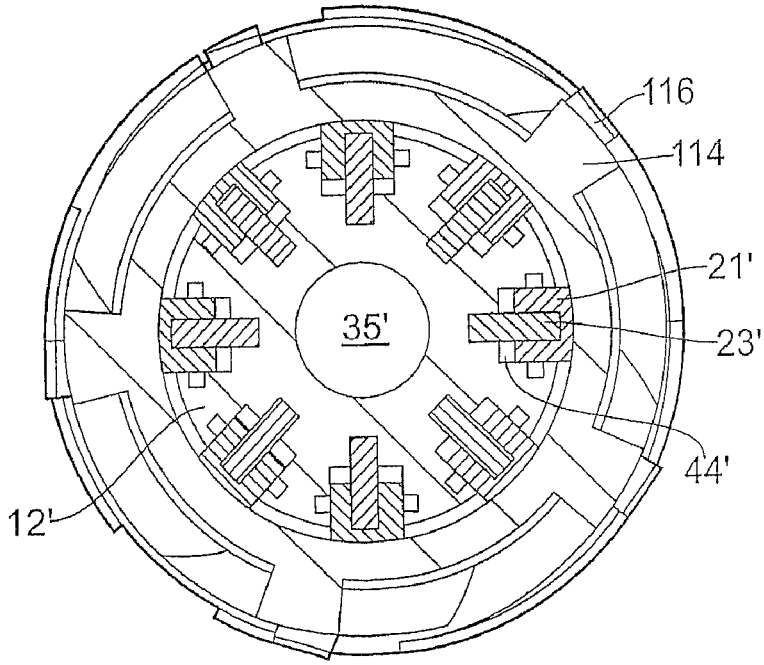
FIG. 14 is a cross-sectional view of the device of FIG. 12 in a plane perpendicular to the longitudinal axis of the device at XIV-XIV in FIG. 13.

The directional drilling device shown in FIGS. 12 to 14 may be provided with a similar arrangement to that described with reference to FIG. 6B, that is to say hydraulic galleries may be provided in the body 12' for delivering high pressure hydraulic fluid to the region between the cylindrical cutter and the body 12' to prevent the accumulation of drilling debris in the radial gap between the two components. Similarly, the cylindrical cutter may have a cutting diameter, as defined by the radius of the cutting elements 116 on the cylinder, which is greater than the cutting diameter of the drill bit when attached to the end 112 of the body 12' to enable operation in accordance with the drilling method hereinbefore described wherein the bore hole cut by the drill bit is subsequently enlarged by the movable cutter so that the movable cutter is in continuous cutting contact with the formation being drilled as the drill string rotates independently of radial displacement of the movable cutter with respect to the body 12'

Referring generally to the various embodiments disclosed herein, in order to hold the rotary disc valve geostationary, a roll stabilized electronics platform could be used, as described in UK patent application No. 9213253, or a strapped down electronics system could be used such as those commonly found in "measurement while drilling" tools (MWD) with an electric motor providing the rotational control for the rotary disc valve control shaft.

Figure 11:
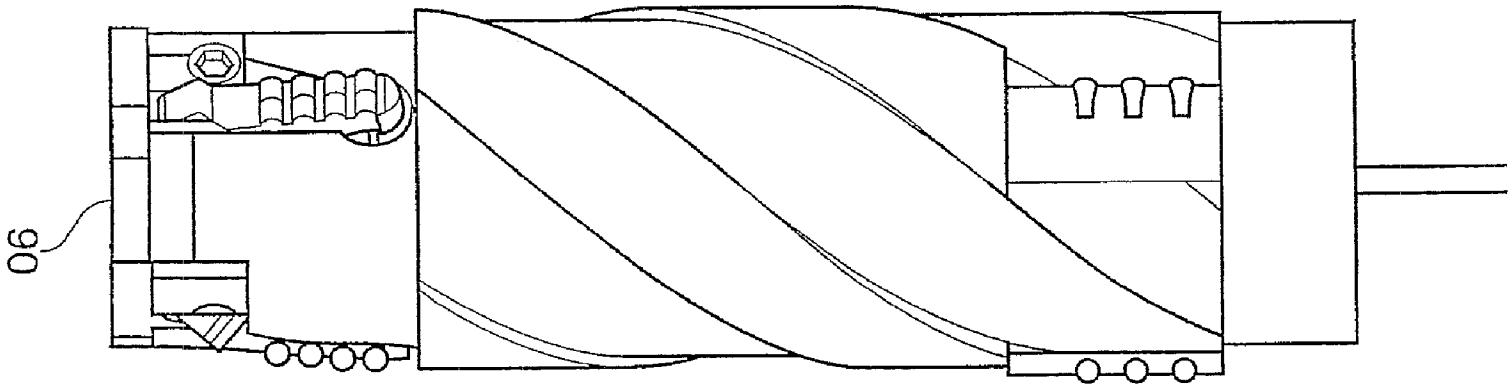
FIG. 11 shows a directional drilling system for use with a conventional drill bit.

The dynamic cutters have been shown to be a part of a drill bit body which also includes the drill bit cutters 15 as shown in FIG. 2. The present invention also contemplates embodiments in which the drill bit body comprises a separate assembly which is attached to the bottom of a dynamic cutters body 90 shown in FIG. 11, as is commonly the case in most rotary steerable systems. This would allow the use of any existing or conventionally designed form of drill bit with the dynamic cutting tool of the present invention. Furthermore the present invention is not limited to PDC bits; a roller cone or natural diamond bit or any other suitable cutter material could be used.

Although aspects of the invention have been described with reference to the embodiment shown in the accompanying drawings, it is to be understood that the invention is not limited to that precise embodiment and various changes and modifications may be effected without further inventive skill and effort. For instance, it is to be understood that the rotary disc valve is only one means of controlling the fluid flow to the dynamic cutter actuating pistons and is shown by way of example only. It will be appreciated that other forms of hydraulic switching mechanisms could be employed.

The use of hydraulic pistons for deploying the dynamic cutters from the inner to outer radial position is shown by way of example and it will be appreciated that other arrangements for mechanically deploying the cutters could by employed.

The dynamic cutters have been shown to pivot about an axis which is perpendicular and offset from the axis of rotation of the drilling tool.

The pivot point could be either up or down hole of the actual dynamic cutters. The pivot point could contain a hard wear resistant sleeve or a soft sacrificial sleeve. The pivot point could be integrated into the drilling tool body or be a separately attached component.

Other axes could be used such as one which is parallel and offset from the drilling tool axis of rotation. In this case the pivot axis could either lead or follow the actual cutting face on the dynamic cutters. Again the pivot point could contain a hard wear resistant sleeve or a soft sacrificial sleeve and pivot point could be integrated into the drilling tool body or be a separately attached component.

The dynamic cutters are shown in the drawings with the piston or force application point and cutting elements on the same side of the pivot point. The dynamic cutters could be provided by deploying dynamic cutters having a pivot point between the force application point and cutting elements.

An alternative method would be to allow the dynamic cutters to slide radially outward on guide pins or rods. The cutter outer radial position would be controlled by contacting with the drilling tool body. A wear resistant material could be used on the guide pins and piston to prolong their life.

The dynamic cutters could also be displaced from the inner to outer radial position by use of a multi bar linkage which is attached to both the drilling tool body and the dynamic cutters.

The dynamic cutters could also be displaced by sliding on a plane surface which is inclined to the rotational axis of the drilling tool. By sliding the cutters on this plane surface, the radial position could be changed from the inner positions to their outer positions.

The dynamic cutters could be allowed to return to their inner positions by the forces exerted from the formation being drilled or by mechanical means such as springs or differential pressure or magnetic force.

The movement of the dynamic cutters from the inner to outer positions could be provided by the following means:

A hydraulic piston could be used with the fluid source being either the mud in the drill string having a differential pressure between the inside and outside of the drill string. In this case the fluid would be lost to the annulus of the drill string after a piston has been energized, this is commonly known as an open system. The piston could be either physically or mechanically attached to the dynamic cutters or consist of a separate component from the cutters. The piston could either operate in a toroidal bore or a linear bore. The piston seal could be either attached to the piston or the drilling tool body. The piston could be made from a wear resistance material or coated with such a material, the piston seal being made from a polymer or other sealing material which are commonly used in drilling tools.

Furthermore a closed system using hydraulic oil which is recycled and reused after each piston is energized could be used. Means for creating a hydraulic pressure differential would be required such as a linear actuation pump or rotary pump. Means for storing the hydraulic fluid on the lower pressure side would be required such as a reservoir. A valve would be required to control the movement of fluid from the pump to the pistons.

A valve for use in either the open or closed systems could be placed in either the inflow or outflow paths of the piston which could consist of either a rotary disc valve, linear piston type valve, sliding gate valve, poppet or plunger type of valve.

The valves could be operated by electrically controlled devices such as solenoids or stepper motors or electro-mechanical ratcheting devices.

The dynamic cutter movement could also be provided by mechanical means, for example a cam could be used to move a respective cutter from the inner to outer position. The cam would be held geo-stationary on the axis of rotation of the drilling tool and a rocker or plunger would be used to transmit the radially force from the cam onto the dynamic cutter. The cam would be held geo-stationary by an electro-mechanical device such as a servo motor.

A scotch-yoke could be used to produce a linear motion to which each dynamic cutter is attached. The dynamic cutters could then either pivot as described above or be guided on pins.

The dynamic cutters could also moved from their inner to outer radial positions by using a rack and pinion or ball and screw. A servo motor would be used to provide the rotary motion.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A method of controlling a drilling direction of a rotary drill string when drilling boreholes in subsurface formations, said drill string comprising a rotary drill bit at a drilling end thereof and directional control means, adjacent said drill bit, including at least one directional cutting member radially movable with respect to a longitudinal drilling axis of said drill string, said method comprising the steps of:

(a) drilling a substantially circular cross section pilot bore hole having a radius determined by a cutting radius of said drill bit of said drill string; and (b) controllably moving the at least one directional cutting member radially, as the drill is rotated, so that a radial position of said cutting member, with respect to the drilling axis, is synchronized with the rotation of said drill bit so that said cutting member continuously engages a wall of said pilot bore hole to enlarge said bore hole as said drill rotates and causing a cross-section of said bore hole to form a non-circular hole superimposed on said pilot hole when it is desired to cause a direction of said advancing drill bit to deviate from a linear path;

wherein said directional cutting member is movable between a first radially extended position and a second radially retracted position, with respect to said drilling axis, and said directional cutting member moves between said first radially extended position and said second radially retracted position as said drill string rotates and has a minimum cutting radius in said retracted position greater than the radius of said pilot bore hole.

2. A directional drilling device for controlling a drilling direction of a rotary drill bit when drilling boreholes in subsurface formations: said directional drilling device being positionable at or towards an end of a drill string for rotation with the drill string about a longitudinal drilling axis; said device comprising:

(a) a drill bit having a cutting radius R, said drill bit being connected to a rotatable body at a downhole end thereof for rotation with said rotatable body about a longitudinal drilling axis;

(b) at least one directional cutting member movably mounted with respect to said rotatable body; said at least one directional cutting member being movable radially with respect to said longitudinal axis of said body for engagement with a wall of a pilot borehole cut by said drill bit; said directional cutting member having a minimum cutting radius about said drilling axis greater than R;

(c) directional control means for synchronizing the radial movement of said directional cutting member with respect to said rotatable body in accordance with the rotational position of said rotatable body in said pilot bore hole; and further comprising means for directing pressurized fluid to a region between said rotatable body and said at least one cutting member.

3. A drilling device according to claim 2, wherein said control means comprises a hydraulic or pneumatic circuit for moving said at least one directional cutting member radially between respective extended and retracted radial positions.

4. A drilling device according to claim 3, wherein said hydraulic circuit comprises a valve means for selectively moving said at least one directional cutting member between said respective extended and retracted radial positions.

5. A drilling device according to claim 4, wherein said valve means comprises a rotary valve for selectively moving said at least one directional cutting member between said respective positions in dependence on the relative rotational position of the said valve with respect to said rotatable body member.

6. A drilling device according to claim 4, wherein said valve means comprises at least one of an electro-magnetic solenoid, gate, ball, or cylindrical valve for selectively moving said at least one directional cutting member between said respective extended and retracted radial positions.

7. A drilling device according to claim 4, wherein the said cutting member is provided with a respective hydraulic piston-and-cylinder actuator for moving and maintaining said at least one directional cutting member in a radially extended position, said cylinder of said actuator being hydraulically coupled to said valve means.

8. A drilling device as claimed in claim 7, wherein said piston of said actuator is slidably mounted on a guide fixed in relation to said rotatable body member.

9. A drilling device as claimed in claim 8, wherein said piston of said actuator is slidably mounted on a guide pin fixed in relation to said rotatable body member.

10. A drilling device as claimed in claim 7, wherein a seal is provided between said piston and said cylinder of said actuator.

11. A drilling device as claimed in claim 10, wherein said seal is mounted on either said piston or said cylinder.

12. A drilling device as claimed in claim 7, wherein said cylinder is provided in said rotatable body member.

13. A drilling device according to claim 7, wherein a secondary piston-and-cylinder assembly is provided for urging said at least one directional cutting member to a radially retracted position.

14. A drilling device as claimed in claim 3. wherein said at least one cutting member is slidably mounted with respect to said rotatable body member for movement between said respective extended and retracted positions.

15. A drilling device as claimed in claim 14, wherein said at least one cutting member is slidably mounted with respect to said rotatable body member on an axis offset from, and perpendicular to, the axis of rotation of said device.

16. A drilling device as claimed in claim 15, wherein the said cutting member is located within a respective recess provided in that said body member.

17. A drilling device as claimed in claim 2, comprising a plurality of cutting members substantially equally spaced about a periphery of said rotatable body member.

18. A drilling device as claimed in claim 17, wherein three or more of said at least one cutting members are provided evenly spaced about said drilling axis.

19. A drilling device as claimed in claim 2, wherein said at least one cutting member is pivotally mounted with respect to said body member.

20. A drilling device as claimed in claim 19, wherein said at least one cutting member is pivotally mounted to said rotatable body member at, or adjacent, one end thereof.

21. A drilling device as claimed in claim 19, wherein said at least one cutting member is pivotally mounted with respect to said rotatable body member on a pivot axis offset from the axis of rotation of said drilling device.

22. A drilling device as claimed in claim 19, wherein said cutting member is pivotally mounted with respect to said body member on a pivot axis offset from and perpendicular to said axis of rotation of said drilling device.

23. A drilling device according to claim 2, wherein movement of said at least one cutting member is limited by a stop member.

24. A drilling device as claimed in claim 2, further comprising a drill string stabilizer adjacent said at least one cutting member for generating a lateral force on an associated drill bit, in use, for altering the direction of said drilling axis.

25. A drilling device according to claim 24, wherein said stabilizer is provided with a plurality of helical blades uniformly spaced around said drilling axis.

26. A drilling device according to claim 2, wherein each of said at least one cutting members comprises an arm on which a set of cutting elements are provided.

27. A drilling device according to claim 26, wherein said arm is mounted on a pivot pin between and provided with a bearing which is either formed of a hardwearing material, such as diamond or polycrystalline diamond, or of a sacrificial material.

28. A directional drilling device for controlling a drilling direction of a rotary drill bit when drilling boreholes in subsurface formations; said directional drilling device being positionable at, or towards an end of, a drill string for rotation with said drill string about a longitudinal drilling axis; said directional drilling device comprising:

(a) a rotatable body including a drill bit or means for connecting a drill bit to said rotatable body at a downhole end thereof for rotation with said rotatable body about a longitudinal drilling axis;

(b) at least one directional cutting member movably mounted with respect to said rotatable body; said at least one directional cutting member being movable radially with respect to said longitudinal axis of said rotatable body for engagement with a wall of a borehole cut by said drill bit such that a geometric center of said at least one cutting member may be aligned substantially coincident with the axis of rotation of said rotatable body member or radially offset therefrom by relative radial movement such that said movable cutter is capable of following an eccentric path with respect to said rotatable body member and said drill bit as said rotatable body member and said drill bit rotate during drilling to selectively enlarge said bore hole cut by said drill bit; and, (c) directional control means for synchronizing said radial movement of said at least one directional cutting member in accordance with the rotational position of said rotatable body in said bore hole being drilled.

29. A directional drilling device according to claim 28, wherein said at least one cutting member comprises a cylindrical member disposed around an exterior of said body member and having at least one cutting element on a radially outer surface thereof.

30. A directional drilling device according to claim 29, comprising a plurality of cutting elements spaced about the periphery of said cylindrical member of each one of said at least one cutting member.

31. A directional drilling device according to claim 28, wherein said control means comprises a hydraulic or pneumatic circuit for moving said at least one cutting member radially with respect to said drilling axis.

32. A directional drilling device according to claim 31, wherein said hydraulic circuit comprises a valve means for selectively moving said at least one cutting member between said respective positions.

33. A directional drilling device according to claim 32, wherein said valve means further comprises a rotary valve for selectively moving said at least one cutting member in said radial direction in dependence on a relative rotational position of said valve with respect to said body member.

34. A directional drilling device according to claim 33, wherein said valve means comprises at least one of an electromagnetic solenoid, gate, ball, or cylindrical valve for selectively moving said at least one cutting member between said respective positions.

35. A directional drilling device according to claim 32, wherein said at least one cutting member is provided with at least one hydraulic piston-and-cylinder actuator for moving and maintaining said at least one cutting member in an extended radial eccentric position, said cylinder of said actuator being hydraulically coupled to said valve means.

36. A directional drilling device according to claim 35, wherein said cutting member is provided with a plurality of said piston-and-cylinder actuators.

37. A directional drilling device according to claim 35, wherein each of said pistons of each of said actuators is slidably mounted on a guide fixed in relation to said rotatable body member.

38. A directional drilling device according to claim 37, wherein each of said pistons is slidably mounted on a guide pin fixed in relation to said rotatable body member.

39. A directional drilling device according to claim 35, wherein a seal is provided between each one of said pistons and each one of said corresponding cylinders.

40. A directional drilling device according to claim 39, wherein said seal is mounted on either said piston or said corresponding cylinder.

41. A directional drilling device according to claim 35, wherein said cylinder is provided in said rotatable body member.

42. A directional drilling device according to claim 28, further comprising a drill string stabilizer adjacent said at least one cutting member for generating a lateral force on an associated drill bit, in use, for altering the direction of said drilling axis.

* * * * *